US011141674B2

(12) United States Patent
Zenevics

(10) Patent No.: US 11,141,674 B2
(45) Date of Patent: Oct. 12, 2021

(54) BUILDING TOY

(71) Applicants: Rodions Zenevics, Jelgava (LV); Olga Litvinova, Riga (LV)

(72) Inventor: Rodions Zenevics, Jelgava (LV)

( * ) Notice: Subject to any disclaimer, the term of this patent is extended or adjusted under 35 U.S.C. 154(b) by 164 days.

(21) Appl. No.: 16/071,180

(22) PCT Filed: Jan. 20, 2017

(86) PCT No.: PCT/IB2017/000324
§ 371 (c)(1),
(2) Date: Jul. 19, 2018

(87) PCT Pub. No.: WO2017/130069
PCT Pub. Date: Aug. 3, 2017

(65) Prior Publication Data

US 2020/0246717 A1 Aug. 6, 2020

(30) Foreign Application Priority Data

Jan. 25, 2016 (RU) ..... RU2016102188

(51) Int. Cl.
*A63H 33/06* (2006.01)
*A63H 33/08* (2006.01)
(Continued)

(52) U.S. Cl.
CPC ..... *A63H 33/062* (2013.01); *A63H 33/086* (2013.01); *A63H 33/12* (2013.01); *A63H 3/16* (2013.01); *A63H 17/002* (2013.01)

(58) Field of Classification Search
CPC .. A63H 33/062; A63H 33/067; A63H 33/065; A63H 33/086; A63H 3/12; A63H 33/12; A63H 17/002
(Continued)

(56) References Cited

U.S. PATENT DOCUMENTS 2,119,921 A * 6/1938 Levy ..... A63H 33/062 446/116
2,450,326 A 9/1948 Berger et al.
(Continued)

FOREIGN PATENT DOCUMENTS

RU 2448754 C2 4/2012

*Primary Examiner* — Eugene L Kim
*Assistant Examiner* — Matthew B Stanczak
(74) *Attorney, Agent, or Firm* — Mendelsohn Dunleavy, P.C.; Steve Mendelsohn

(57) ABSTRACT

The invention relates to children's construction kits for assembling building toys from connecting elements. The technical result is an increase in functional capabilities, permitting the assembly of simple and complex spatial constructions with dynamic properties. This technical result is achieved by virtue of a building toy consisting of a set of flat shape-forming and decorative modular elements made of a flexible resilient material and having fastening elements attached to the surfaces thereof, said fastening elements forming detachable joints capable of holding together connected portions of the surfaces, wherein each of the fastening elements takes the form of the centre of axial rotation of at least the held portion of the surface of a connected modular element, and each of the shape-forming modular elements has on its opposite surfaces at least one coaxial pair of fastening elements which are rigidly interconnected and have oppositely oriented mating surfaces.

8 Claims, 5 Drawing Sheets

Figure 1:
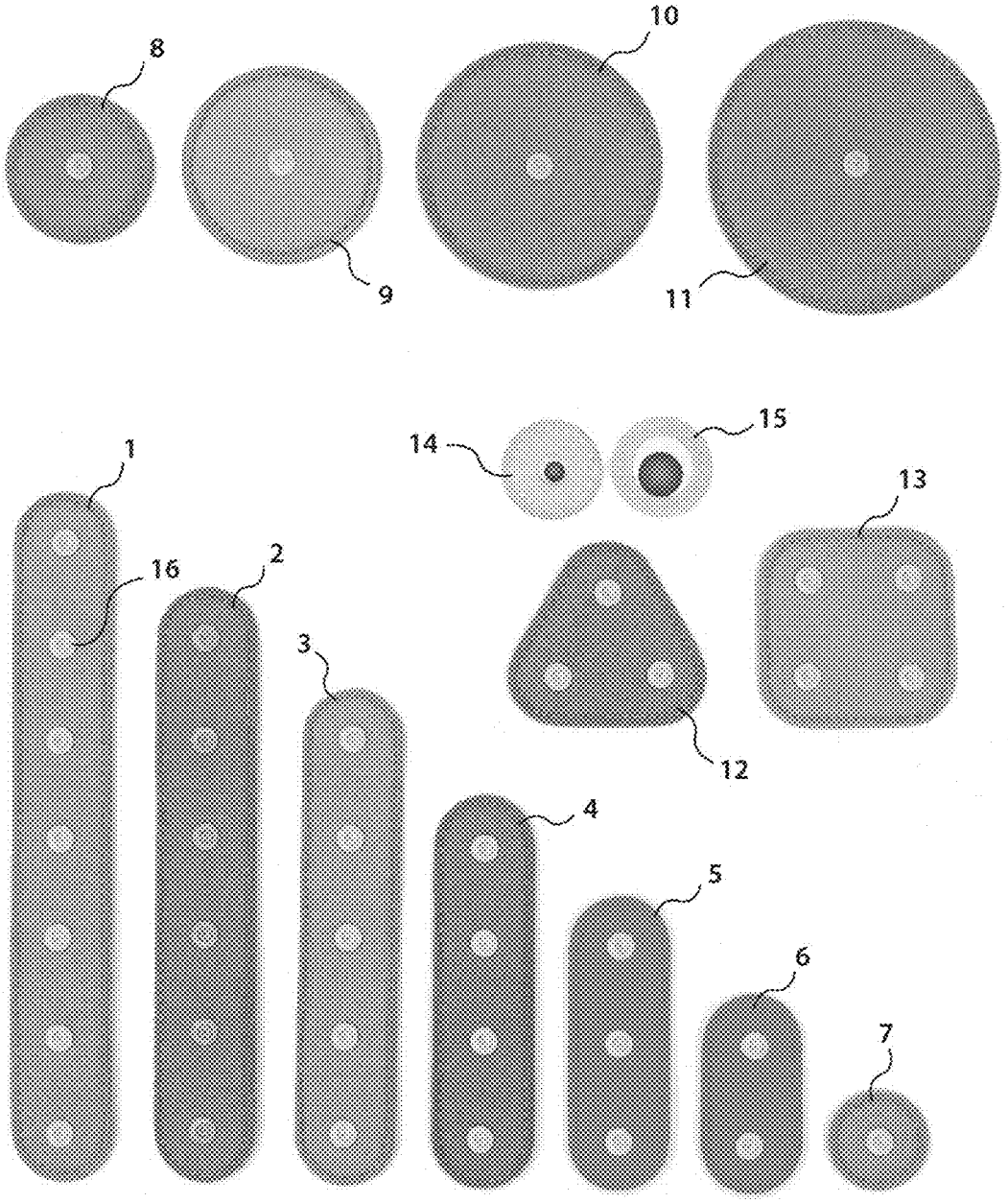

(51) Int. Cl.
*A63H 33/12* (2006.01)
*A63H 3/16* (2006.01)
*A63H 17/00* (2006.01)

(58) Field of Classification Search
USPC ..... 446/124–125
See application file for complete search history.

(56) References Cited

U.S. PATENT DOCUMENTS 2,486,550 A * 11/1949 Bonkowski ..... A63H 3/16 446/97
2,649,803 A * 8/1953 Andre ..... A63H 33/062 446/104
3,139,698 A * 7/1964 Arnold ..... A63H 33/084 446/124
3,315,376 A * 4/1967 Nielsen ..... G09B 1/40 434/160
3,442,044 A * 5/1969 Quercetti ..... A63F 9/06 446/124
3,841,019 A * 10/1974 Lorenzo ..... A63H 3/36 446/100
4,164,091 A * 8/1979 Lin ..... A63H 33/086 446/118
4,176,493 A * 12/1979 Dideriksen ..... A63H 33/042 446/102
4,242,767 A 1/1981 McMullen et al.
4,381,618 A 5/1983 Krisel
4,390,101 A * 6/1983 Humphreys ..... H05K 7/1418 211/41.17
4,538,394 A * 9/1985 Farnum ..... G03B 37/00 52/664
4,604,073 A * 8/1986 Livesey ..... A63H 33/065 446/117
4,902,259 A * 2/1990 Ziegler ..... A63H 33/065 446/117
5,832,687 A * 11/1998 Willemsen ..... A63H 33/04 52/592.6
6,086,444 A * 7/2000 Glickman ..... A63H 33/08 446/120
6,176,756 B1 * 1/2001 Panec ..... A63H 3/04 446/321
6,948,998 B2 * 9/2005 Bagley ..... A63H 33/062 446/104
9,480,931 B1 * 11/2016 Samo ..... A63H 33/065
10,596,480 B1 * 3/2020 Samo ..... A63H 33/065
2008/0045116 A1 * 2/2008 Barcelo ..... A63H 33/101 446/124
2010/0221977 A1 * 9/2010 Bruzgul ..... A63H 33/108 446/124
2011/0230113 A1 * 9/2011 Tzoreff ..... A63H 33/084 446/124
2013/0102220 A1 * 4/2013 Wang ..... A63H 33/067 446/102
2013/0149935 A1 * 6/2013 Mimlitch, III ..... A63H 33/12 446/124

* cited by examiner

BUILDING TOY

CROSS-REFERENCE TO RELATED APPLICATIONS

This application claims the benefit under 35 U.S.C. 119 of the filing date of 20 Jan. 2017 for PCT patent application no. PCT/IB2017/000324, which in turn claims the benefit of the filing date of 25 Jan. 2016 for Russian patent application no. 2016102188.

FIELD

The invention relates to children's construction kits for assembling building toys with the use of connecting elements.

BACKGROUND OF THE INVENTION

In the state of the art there is a known multi-model toy construction kit (Patent RU 104081, Int.Cl.: A63H33/10, publ. 10 May 2011), that contains a set of structural parts with through-holes and connecting elements, wherein the through holes of the structural parts are arranged in 1-3 rows wherein several holes have the same diameter in a row and around the perimeter of discs, except a central hole of the discs, and plain washers, in which the diameter is smaller. The thickness of the discs is 5-10 times bigger than in all structural parts, and in angle pieces the holes are oval on one side, and the distance from the centers of the holes to the folding line is twice the distance from the centers of the holes to the ends of the angle pieces, the edges of the angle pieces being rounded.

The rigid, static shape of the parts of the said construction kit does not allow them to transform their linear dimensions, or change their volume and proportions, which considerably limits the amount of possible variants of assembled models. Also, the large number of bolt and rod connecting elements increases labor input and the complexity of assembling the models, as well as increasing the risk of injury to a child while playing.

A soft toy construction kit is known in the prior art (Certificate of utility model RU 2195, Int.Cl.: A63H3/02, publ. 16 Jun. 1996), that consists of a body and parts attached to the body or to each other with the help of fixation devices, wherein some of the mentioned fixation devices are made in the form of pairs of separable connecting elements, one of which is attached to one part, while the other is attached to another part or to the body; and there is provided at least one additional part and/or at least one additional body with fixation devices attached to them.

The major unsatisfactory features of the above-mentioned construction kit are the following: a minimum number of variants of the assembled models, negative stability of the assembled toys, inability to fix the changed form of the modular elements.

As the prototype, the known construction kit of a soft toy was chosen (Patent RU 2448754, Int.Cl.: A63H33/04, publ. 27 Apr. 2012), which comprises a set of modular elements with tools to connect elements to each other which are made of cloth or some other flexible material in the form of geometric shapes or forms with fastening elements attached to their surface. These fastening elements can temporarily hold the connecting points together or portions of the surface of the modular elements, wherein the fastening elements are selected and placed on the surface of each modular element in such a way that the original shape of the modular element can be reversibly changed, subjected to transformation by bending, folding, twisting or turning. The reshaped modular element is fixed by fastening elements.

Unsatisfactory features of this construction kit are:

- Low reliability of fixation of the one-side fastening elements to the surface of the modular element. As a result of continual connection and disconnection manipulations with the construction kit, the mating surface of the modular element gets gradually destroyed, which causes early separation of the fastening element.
- The impossibility of assembling models and constructions with dynamic characteristics, which decreases the number of possible game manipulations with the assembled model.
- The impossibility of creating a stable volumetric structure from modular elements, an attempt to form it leading to deformation disruption of the shape due to the action of gravity forces from its own mass of the structure.

DISCLOSURE OF TECHNICAL SOLUTION

The technical result achieved by the use of the claimed building toy, extends the functional capabilities of such construction kits, and provides the possibility of assembling both simple models and complex spatial constructions with dynamic properties, highly stable geometric parameters under increased loads and high reliability of fixation of the fastening elements at the surface of the modular element.

To achieve the above mentioned technical result there is provided a building toy, which consists of a set of flat shape-forming and decorative modular elements of flexible resilient material in the shape of geometrical figures or forms with fastening elements attached to their surfaces that form detachable joints capable of holding connected portions of the surfaces together, wherein the fastening elements are placed on the surface of at least part of the shape-forming modular elements in such a way that the original form of such modular element can be reversibly changed with the following fixation of the changed forms by the above mentioned fastening elements. Wherein according to the suggested technical solution each of the fastening elements is formed as the center of axial rotation at least of the held portion of the surface of the connected modular element, where each of the shape-forming modular elements on its opposing surfaces has at least one coaxial pair of fastening elements rigidly interconnected and being oppositely oriented by their mating surfaces to form a double-sided fixation device.

The realization of the fastening element in the form of the center of axial rotation at least of the retained area of the surface of the connected modular element makes it possible to provide dynamic properties of the assembled models, for example, the possibility of angular rotation of the limbs of animal figures.

The realization of each of the shape-forming modular elements which has at least one coaxial pair of fastening elements on its opposite surfaces, rigidly interconnected and have oppositely oriented mating surfaces which form double-sided fixation device, wherein the coaxial pair ensures high reliability of fixation of fastening elements on the surface of the modular element. In addition the rigid connection of the coaxial fastening elements increases the stiffness and end stability of multi-layered forms, both under the influence of gravity of its own construction and under impact during play allowing the performance of game manipulations with the model entailing heavy pressure.

The coaxial arrangement of the fastening elements provides the possibility of building up multi-layered forms from flexible modular elements that are identical or are of the same type without longitudinal and transverse displacements of the connected surfaces, which expands the playing possibilities of the construction kit. The rigid connection of the coaxial fastening elements increases rigidity and end stability of multilayered forms both under the influence of gravity of its own construction and under impact during play allowing playing manipulations of the model coupled with heavy pressure on its surface.

In addition, the fastening element of the modular element can be made as the center of axial rotation of the part of the surface of the connected modular element or the center of axial rotation of the entire surface of the connected modular element, for example, vehicle propulsion drives (wheels, screws etc.)

In addition, the fastening elements that form the detachable joint can be embodied either as an inner metal and an outer magnetic mating fastening elements or as an inner fastening element provided with a projection in the form of a surface of revolution which widens at its end and an outer fastening element which provides the surface with full or partial resilient coverage of the projection of the inner fastening element. These detachable joints ensure reliable fixation and the possibility of axial rotation of the connected portions of the modular elements.

In addition, depending on the requirements presented to the modular element, the double-sided fixation device can consist of outer and inner fastening elements, either a pair of outer fastening elements, or a pair of inner fastening elements.

In addition, fastening elements of the double-side fixation device can be rigidly connected to each other from the side of their supporting surfaces by means of a connecting central rod made of solid resilient material, for example, plastic, which passes through a through hole of the modular element. This implementation of the double-side fixation devices provides the possibility of elastic axial bending of the connected elements of double-side fixation devices which further improves the dynamic characteristics of the created models or constructions.

Moreover, the length of the connecting central rod can be less than the thickness of the modular element, which causes resilient deformation of the surfaces of contact with the bases of the coaxial fastening elements with their partial indentation into the surfaces of the modular elements. This provides an additional rigid resilient connection of the connected modular elements, as there is no gap formed by the protruding parts of the mating connections.

In addition, the fastening elements of the double-side fixation devices can be connected with each other by their bearing surfaces depending on the requirements of the construction kit.

In addition, the fastening elements or parts of the fastening elements, depending on the requirements of the construction kit can be made of plastic or metal.

In addition, modular elements or a part of the modular elements can be made of thick felt, felt, felt-cloth, rubber, PVC fabric, flexible polymer, PVC plastic, or a combination of these materials. The specified materials combine high flexibility and elasticity.

In addition, the modular elements can be made single layer, double layer or multi-layer with a modular element thickness of 3-10 mm. The specified range of thickness of the modular elements ensures the preservation of the flexible and elastic properties of the material.

Moreover the connection of the layers of the modular elements can be carried out by means of an intermediate adhesive layer, or by a line of thread sewing along the edges of the connected layers, depending on the properties of the materials used. Wherein, the modular element of thick felt, felt or felt-cloth should preferably be sewn with a line of thread. Due to the resilient plastic properties of these materials the selvage edge next to the line of sewing thickens the surface of the selvage, giving the modular elements additional resistance to end loads.

In addition, the modular elements can include at least horizontally elongated, rectangular, triangular, circular plates, as well as decorative circular plates.

Moreover, the horizontally elongated plates can be provided with at least two double-side fixation devices installed in a longitudinal row.

Moreover, the rectangular and triangular plates can be provided with one double-side fixation device at the corners.

Moreover, depending on the requirements of the construction kit, the above mentioned modular elements can have sharp and/or rounded ends.

Moreover, the circular plates can have different diameters and be equipped with a double-side fixation device.

Moreover, the decorative circular plates can have on the outer surface a stylized eye in the form of a transparent plastic hemisphere of various diameters, inside of which there is a pupil of various diameters that can freely move, and on the reverse side a central outer or inner fastening element.

SHORT DESCRIPTION OF THE DRAWINGS

Figure 2A:
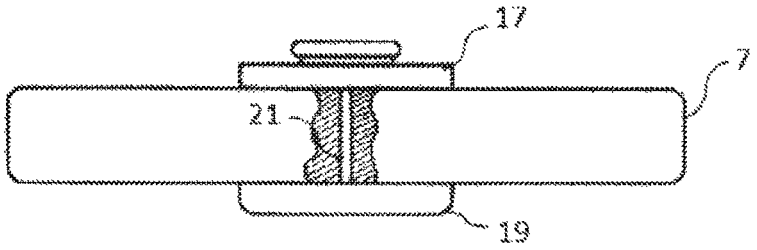
Figure 3:
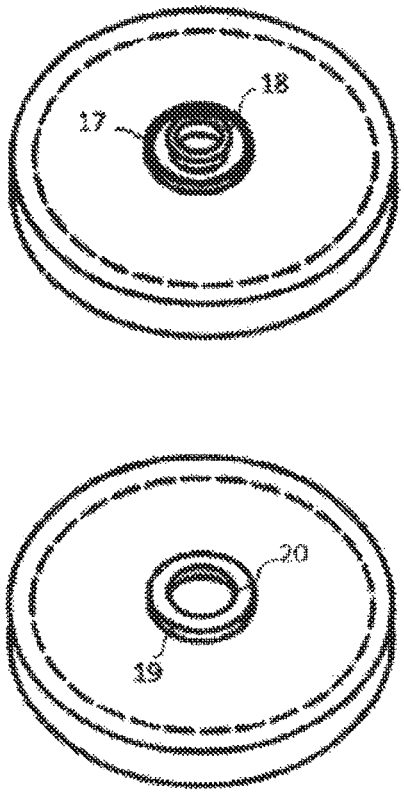
Figure 2B:
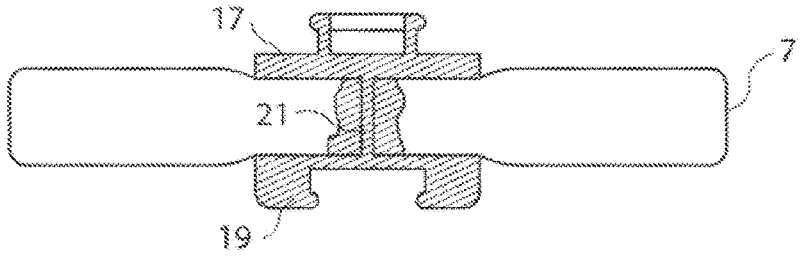
Figure 2C:
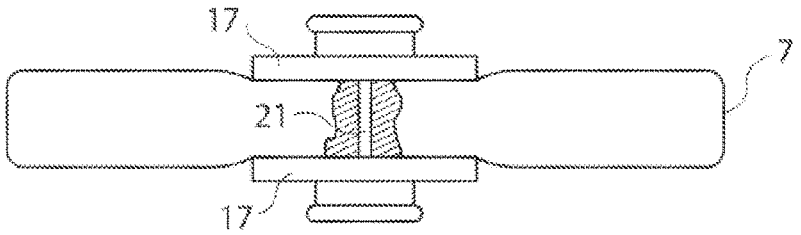
Figure 2D:
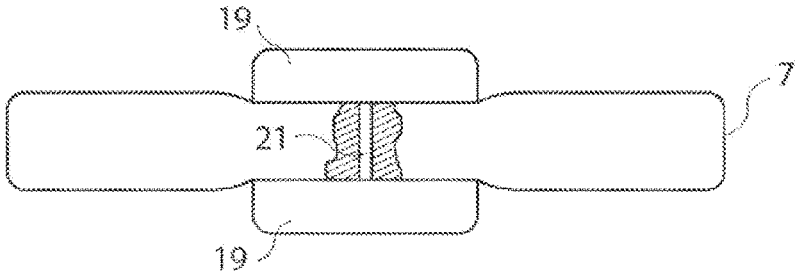
Figure 4:
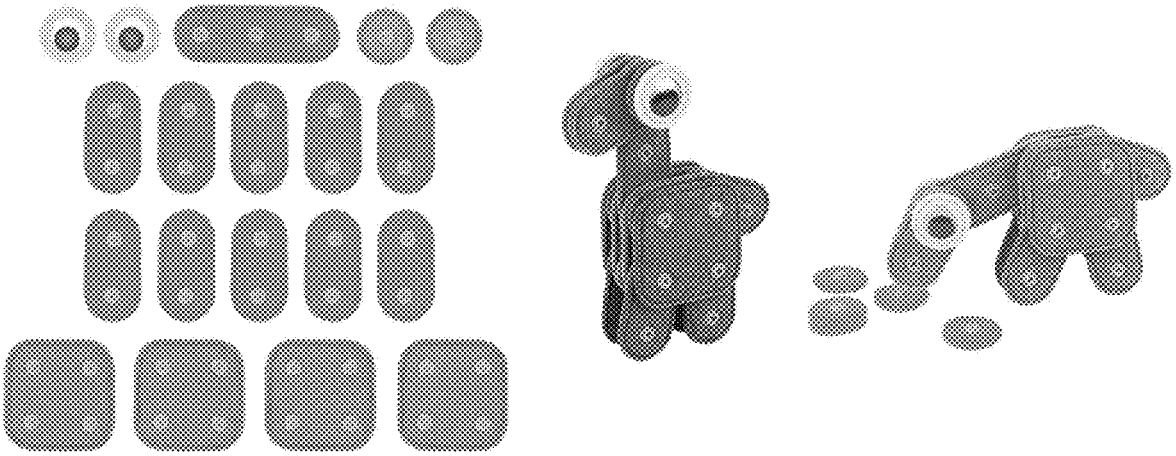
Figure 5:
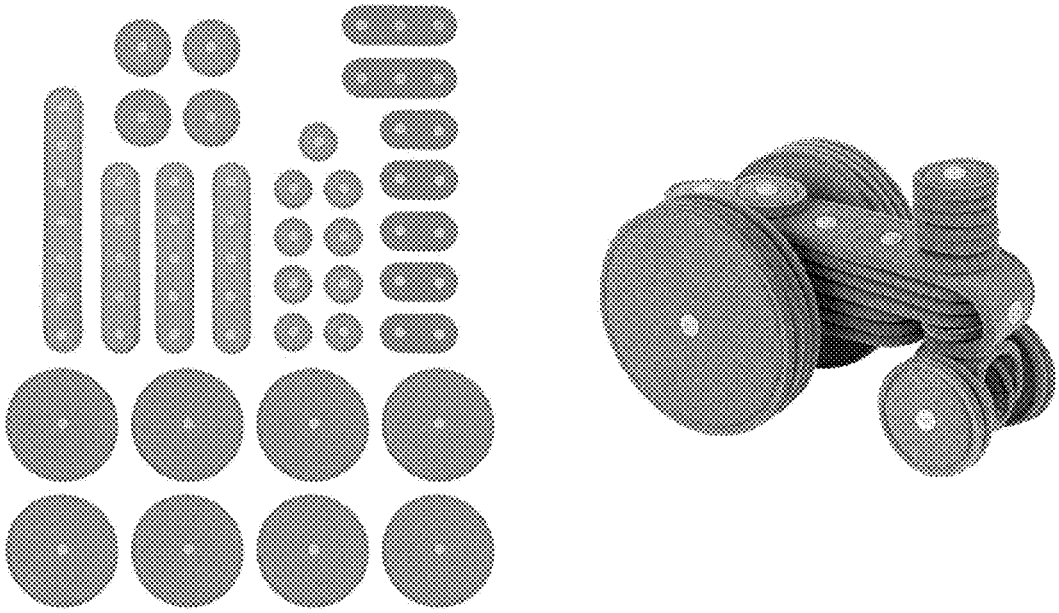
Figure 6:
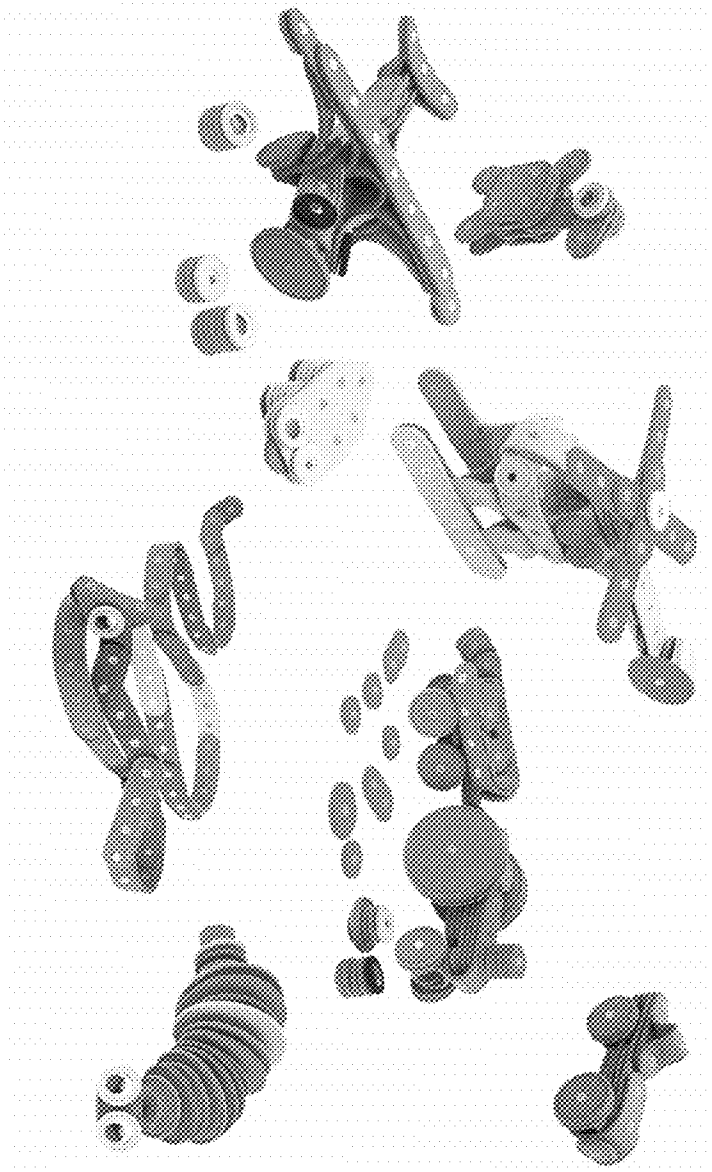

FIG. 1—a set of exemplary construction elements;

FIG. 2A—a modular element with a double-sided fixation device;

FIG. 2B—a modular element with a double-sided fixation device having an inner fastening element and an outer fastening element;

FIG. 2C—a modular element with a double-sided fixation device having two inner fastening elements;

FIG. 2D—a modular element with a double-sided fixation device having two outer fastening elements;

FIG. 3—general view of the modular element from the side of the internal and the external fastening elements;

FIG. 4—a "Horse" model and the modular elements required for its construction;

FIG. 5—a "Tractor" model and the modular elements required for its construction;

FIG. 6—some variants of the models the assembled from the constructor kit.

EMBODIMENT OF THE INVENTION

The claimed construction kit according to the variant shown in FIG. 1, is made of a set of flat modular elements in the shape of plates (1)-(15) which have different geometries and sizes. Each modular element of such a construction kit is made of flexible resilient material, preferably felt or felt cloth, and has two layers connected around their perimeter by a line of thread. Modular elements of the construction kit are equipped with double-sided fixation devices (16) which consist of an inner fastening element (17) which has a projection (18) and an outer fastening element (19), which has the surface of elastic coverage of the projection (20) (FIGS. 2A-2D, 3), connected with each other by an elastic plastic rod (21), that passes through a through hole of the modular element (1) to (15) (example— circular plate 7). When connecting modular elements to each other, or connecting parts of one modular element, fastening elements (17) and (19) form a detachable joint capable of holding together the mating surface portions or the whole mating modular element while providing the possibility of rotating the attachable portion or element by the above-described construction of the fastening elements (17), (19), and also the possibility of axial tilt of the connected sections due to the elasticity of the rod (21). The set of modular elements according to FIG. 1 comprises the following parts: horizontally elongated plates (1)-(6) with a central row of double-sided fixation devices (from 2 to 7) (16); circular plates (7)-(11) of different diameters with a central double-sided fixation device (16) (plate (7) can have a double-sided fixation device with one type of fastening elements); triangular plates (12), with a single double-side fixation device at each corner (16); rectangular (square) plates (13), with a single double-side fixation device at each corner (16); decorative stylized circular plates imitating eyes (14), (15) with the central fixation device (17) or (19).

VARIANTS OF EMBODIMENT OF THE INVENTION

Modular elements of the construction kit, enable to create various spatial constructions and models.

For example, the assembling of the model «Horse» (FIG. 4) is performed in the following way.

Modular elements required:
horizontally elongated plates (5)—1 unit;
horizontally elongated plates (6)—10 units;
square plates (13)—4 units;
circular plates (7)—2 units;
decorative circular plates (15)—2 units.

First we compose the head and the neck. To achieve that the 1st and the 2nd plates (6) (the head) are attached to the 1st fastening elements of the 1st plate (5) (the neck) on each side with their 1st fastening elements and these plates are fastened together with the 2nd fastening elements. Then both plates (7) are fastened on the 1st fastening elements of the plates (6), after that the decorative plates (15) (the eyes) are fastened on them. Then the 1st plate (5) is fastened with the $3^{rd}$ fastening element on the 1st fastening element of the 1st square plate (13). On its 2nd fastening element the 3rd plate (6) is fastened with the 1st fastening element (the tail), and on the 3rd and the 4th fastening elements the 4th plate (6) is fastened with both elements. Then, by analogy with the 1st plate (13) the 2nd plate (13) is fastened on the front surface of the 1st plate (5) and the 3rd and the 4th plates (6). On the front surface of the 2nd plate (13) the 5th plate (6) is fastened to its 1st and 2nd elements. The 1st fastening elements of the 6th and the 7th plates (6) (the legs) are fastened on the 3rd and the 4th fastening elements. After that by analogy with the 2nd plate (13) the 3rd plate (13) (the body) is fastened to the front surface of the 5th, 6th and 7th plates (6). In the same way, on the opposite side of the 1st plate (13) the 8th, 9th, 10th plates (6) are fastened one by one to it, and the 4th plate (13) is fastened to them.

As a result, we get the dynamic model «Horse», in which the limbs—neck, tail and legs—have the possibility of axial rotation with respect to the body, and the head—with respect to the neck. This enables more manipulations with the assembled model, changing the position of its limbs and fixing these changes on the playing surface, while maintaining the sufficient stability of the model.

A more complicated model «Tractor» (FIG. 5) with the sequence of the assembly is given.

Modular elements required:
horizontally elongated plates (1)—1 unit;
horizontally elongated plates (3)—3 units;
horizontally elongated plates (5)—2 units;
horizontally elongated plates (6)—5 units;
circular plates (7)—9 units;
circular plates (8)—4 units;
circular plates (11)—8 units.

First the body is built. To achieve that, the 1st, the 2nd and the 3rd plates (6) are fastened layer-by-layer. The 1st, the 2nd and the 3rd plates (3) are alternately fastened lengthwise on the 3rd plate (6) with the 3rd and the 4th fastening elements. Plate (1) is fastened to the upper plate (3) from the 1st-5th fastening elements. Then the part of its surface with the 6th and the 7th fastening elements is folded so that the 7th fastening element on the opposite side is connected through the 1st circular plate (7) (with similar fastening elements) to the 5th fastening element located on the inner surface of the 1st plate (3). From the bottom of the 1st plate (3), the 2nd circular plate (7) is fastened to the 1st fastening element. The 3rd plate (7) (the steering wheel) is fastened to the 2nd fastening element of the plate (1), and to the 5th fastening element—from the 4th to the 9th plates (7) respectively (the pipe). Next the wheels are assembled. Four circular plates (11) are used for every rear wheel, and two circular plates (8) for every front wheel. The plates are connected by the central fastening element. To form the axis of rotation of the front wheels, the 1st plate (5) and the 4th plate (6) are fastened together by an opposing fold, so that the fastening elements located on the outer surface of the 4th plate (6) are connected to the last in row fastening elements on the inner surface of the 1st plate (5). The fastening element in the center of the outer surface of the 1st plate (5) is fastened to the 7th fastening element of the outer surface of the plate (1), as a result, the center of the angular rotation of the axis of rotation of the front wheels is formed at the junction. Then the front wheels of the plates (8) are fastened with their central fastening elements to the edge fastening elements of the outer surface of the 1st plate (5). In order to form the axis of rotation of the rear wheels, the 2nd plate (5) is passed through the hole between the 2nd and the 3rd fixing points of the fastening elements of the 1st and the 2nd plates (3), then the ends of the 2nd plate (5) are bent and connected with the 5th plate (6) by analogy with the central axis of rotation of the front wheels. At the final stage, the rear wheels of the plates (11) are attached with their central fastening elements to the edge fastening elements of the outer surface of the 2nd plate (5).

The assembled construction clearly demonstrates the dynamic properties of the obtained model «Tractor». Both the wheels and the axis of rotation of the front wheels rotate, which enables game manipulations with the assembled model. At the same time, the wheels are stable, they do not bend under the body's weight, also due to their width, provided by the stated fixation devices.

The proposed building toy has increased amusement and play potential. Use of the given building kit thanks to its above mentioned properties allows a child to form skills necessary for successful psychomotor development.

What is claimed is:

1. A building toy comprising a set of flat shape-forming modular elements made of a flexible resilient material in the shape of geometric figures and having opposing surfaces, wherein:

for each flat shape-forming modular element:

the modular element has at least one double-sided fixation device comprising a coaxial pair of fastening elements, each fastening element of the pair of fastening elements having (i) a base surface in contact with a respective one of the opposing surfaces of the modular element and (ii) a mating surface, the mating surfaces of the pair of fastening elements being oppositely oriented; and the modular element has a through hole, wherein:

the double-sided fixation device fixation device has a central rod made of solid resilient material, passing through the through hole and connecting the base surfaces of the fastening elements of the pair of fastening elements to each other;

the length of the rod is less than the thickness of the modular element causing resilient deformation of the surfaces of the modular element at their point of contact with the bases with partial indentation of the bases into the surfaces of the modular elements; and the mating surfaces of the fastening elements of a modular element in the set are configured to engage with the mating surfaces of the fastening elements of other modular elements in the set to form detachable joints to hold connected portions of the surfaces together, with the fastening elements forming centers of axial rotation of at least the held portions of the surfaces of the connected modular elements.

2. The building toy of claim 1, wherein:

the mating surfaces of the fastening elements that form the detachable joints comprise a mating surface of an inner fastening element and a mating surface of an outer fastening element; and the inner fastening element comprises a projection in the form of a surface of revolution which widens at its end; and the outer fastening element provides a surface with full or partial resilient coverage of the projection of the inner fastening element.

3. The building toy of claim 2, wherein the set includes modular elements in which each double-sided fixation device comprises one of (i) an outer fastening element and an inner fastening element, (ii) a pair of outer fastening elements, and (iii) a pair of inner fastening elements.

4. The building toy of claim 1, wherein the fastening elements are made of plastic or metal.

5. The building toy of claim 1, wherein the modular elements comprise one or more of thick felt, felt, felt-cloth, rubber, PVC fabric, flexible polymer, and PVC plastic.

6. The building toy of claim 5, wherein at least one modular element comprises at least two layers interconnected by an intermediate adhesive layer and/or a line of thread stitching along the edges of the interconnected layers.

7. The building toy of claim 5, wherein the modular elements have a thickness of 3-10 mm.

8. The building toy of claim 1, wherein at least one of the shape-forming modular elements has a horizontally elongated shape having (i) sharp and/or rounded ends and (ii) at least two double-sided fixation devices placed in a row;

at least one of the shape-forming modular elements has a rectangular shape having (i) sharp and/or rounded ends and (ii) a double-sided fixation device at each of four corners;

at least one of the shape-forming modular elements has a triangular shape having (i) sharp and/or rounded ends and (ii) a double-sided fixation device at each of three corners;

at least two of the shape-forming modular elements have circular shapes of different diameter, each having a central double-sided fixation device; and at least two of the shape-forming modular elements having circular shapes have decorative circular shapes, each having (i) on one side, a stylized eye comprising a transparent plastic hemisphere of different diameter, inside of which is a pupil that can move freely and (ii) on a reverse side, a central fastening element having an outer mating element or an inner mating element.

* * * * *